US008350491B2

(12) United States Patent
Sloan et al.

(10) Patent No.: US 8,350,491 B2
(45) Date of Patent: Jan. 8, 2013

(54) SELF ADJUSTING POWER SUPPLY APPARATUS AND METHOD

(75) Inventors: Thomas C. Sloan, Santa Barbara, CA (US); John Koteles, Oxnard, CA (US); Min Kwag, Camarillo, CA (US)

(73) Assignee: The Sloan Company, Inc., Ventura, CA (US)

( * ) Notice: Subject to any disclaimer, the term of this patent is extended or adjusted under 35 U.S.C. 154(b) by 431 days.

(21) Appl. No.: 12/157,430

(22) Filed: Jun. 9, 2008

(65) Prior Publication Data

US 2009/0134816 A1 May 28, 2009

Related U.S. Application Data

(60) Provisional application No. 60/933,910, filed on Jun. 7, 2007.

(51) Int. Cl.
*H05B 37/02* (2006.01)

(52) U.S. Cl. ..... 315/291; 315/307

(58) Field of Classification Search ..... 315/291, 315/307, 308

See application file for complete search history.

(56) References Cited

U.S. PATENT DOCUMENTS

| | | | | |
|---|---|---|---|---|
| 5,697,175 | A | 12/1997 | Schwartz | 40/552 |
| 6,042,248 | A | 3/2000 | Hannah et al. | 362/252 |
| 6,510,995 | B2 * | 1/2003 | Muthu et al. | 235/454 |
| 6,753,661 | B2 * | 6/2004 | Muthu et al. | 315/307 |
| 7,667,414 | B2 * | 2/2010 | Fujino et al. | 315/307 |
| 2004/0251854 | A1 * | 12/2004 | Matsuda et al. | 315/291 |
| 2008/0068298 | A1 * | 3/2008 | Shen et al. | 345/46 |
| 2008/0238340 | A1 * | 10/2008 | Leung et al. | 315/297 |

OTHER PUBLICATIONS

LumiLEDs, Inc., Red Super Flux LED Rail, Part Nos. HLCR-KR99-R0100, HLCR-KR99-R0200, data sheet pp. 1-4.

National Semiconductor 2003, Part No. LM317 3—Terminal Adjustable Regulator data sheet. May 2003 pp. 1-25.

National Semiconductor 2009 LM358 Low Power Dual Operational Amplifier, pp. 1-3.

Microchip Technology, Inc., PIC16C56 Device Migrations, 2001 Data Sheet, pp. 1-4.

Analog Devices, Inc. AD5290 Compact Position Digital Potentiometer, Dec. 2005, pp. 1-3.

* cited by examiner

*Primary Examiner* — Thuy Vinh Tran

(74) *Attorney, Agent, or Firm* — Koppel, Patrick, Heybl & Philpott

(57) ABSTRACT

Apparatus and methods are disclosed that control power supplies to automatically provide the appropriate voltage to drive constant current devices. A lighting system according to the present invention comprises a lighting module having a constant current device that provides a constant current in response to constant current voltage. A power supply is included that generates a power supply voltage coupled to the lighting module. A feedback circuit is included from the lighting module to the power supply causing the power supply voltage to be sufficient to provide a constant current voltage at the LED module. A method according to the present invention for generating a constant current voltage to drive a constant current device, comprises providing a drive voltage to a constant current device. The current at the constant current device is sensed a first time, and the drive voltage is increased. The current to the constant current device is sensed a second time. The drive current is held at its increased level if the current did not increase from the first to the second sensing. The increasing of the drive voltage and sensing of the current is repeated of the current did increase between the first and second sensing.

3 Claims, 5 Drawing Sheets

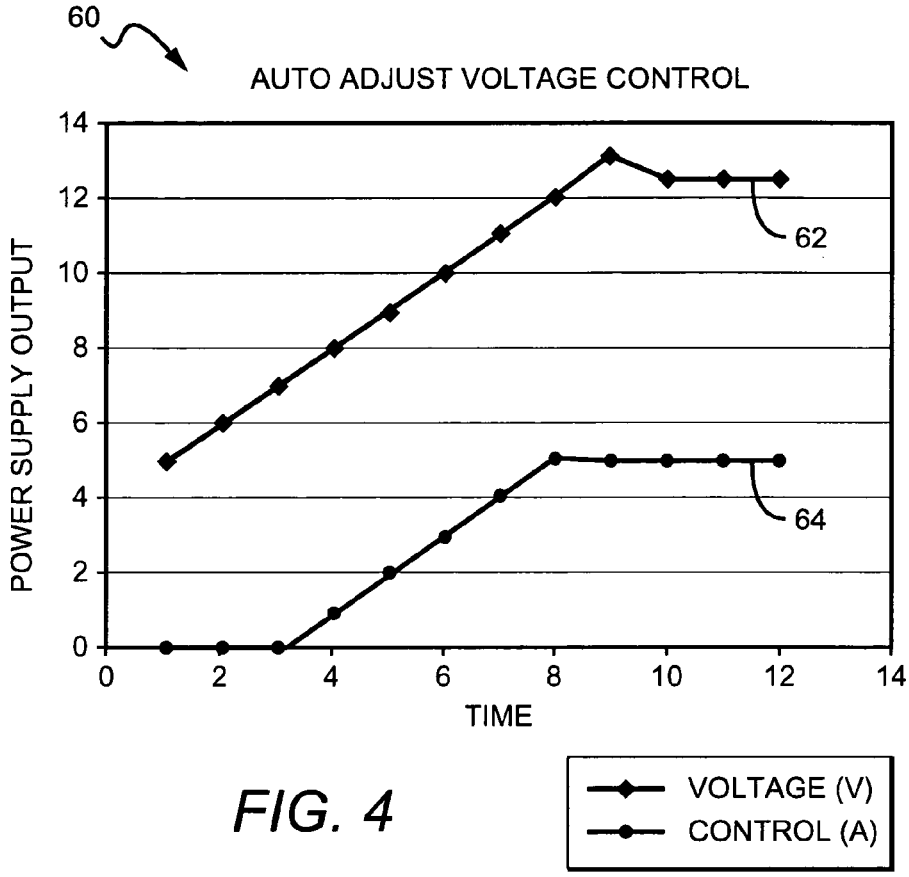
FIG. 4
FIG. 5
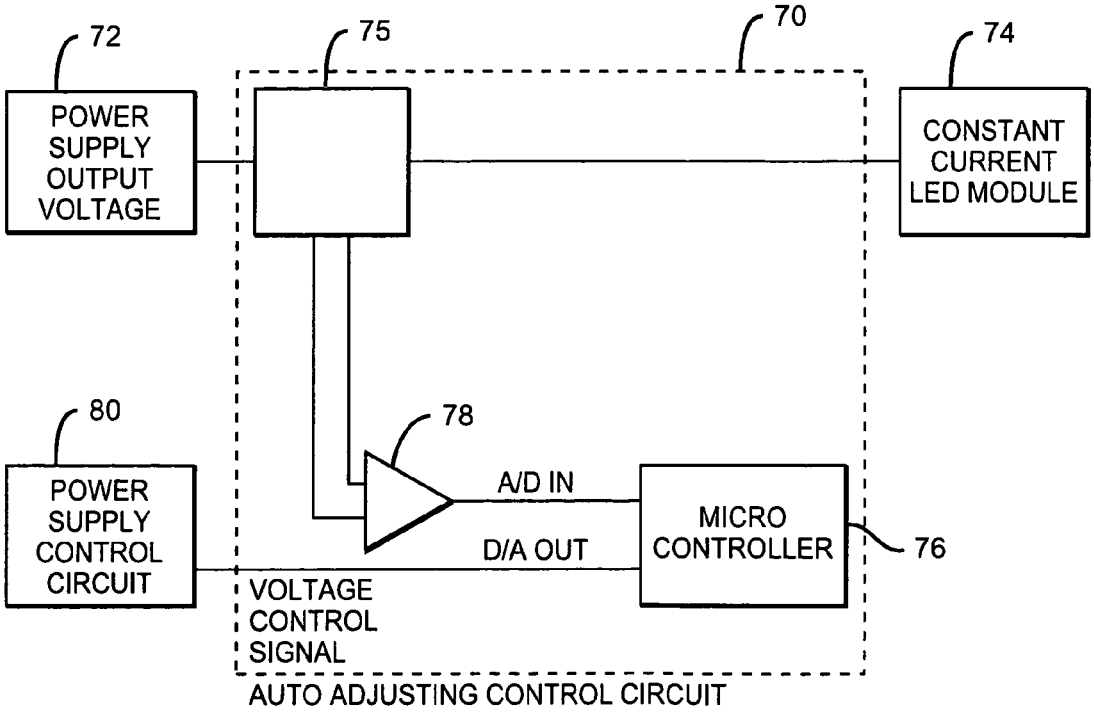

SELF ADJUSTING POWER SUPPLY APPARATUS AND METHOD

This application claims the benefit of provisional application Ser. No. 60/933,910 to Sloan et al., which was filed on Jun. 7, 2007.

BACKGROUND OF THE INVENTION

1. Field of the Invention

This invention relates to power supplies and in particular to a power supply apparatus and method for driving circuits having constant current devices.

2. Description of the Related Art

Advances in light emitting diode ("LED") technologies have resulted in devices that are brighter, more efficient and more reliable. LEDs are now being used in many different applications that were previously the realm of incandescent bulbs; some of these include displays, automobile taillights and traffic signals. As the efficiency of LEDs improves, it is expected that they will be used in most lighting applications.

Channel letters are commonly found on the outside of buildings and are often used to advertise the name of the business. They are typically constructed of an aluminum or plastic housing having the shape of a letter and is approximately 5" deep. The housing has a generally U-shaped cross-section, with the top opening in the housing covered by a colored translucent lens that transmits light from within the housing.

Channel letters are typically illuminated with neon or fluorescent light sources that are mounted within the channel letter housing. Neon and fluorescent lights provide a bright and continuous light source that allows the channel letters to be visible at night. These light sources, however, have a relatively short life (20,000 hours), are fragile, operate at high voltage (7,000 to 15,000 volts for neon) and can consume a relatively large amount of power. Neon bulbs can also experience difficulty with cold starting, which can lead to the bulb's failure.

LEDs are more frequently being used as the light source in many different applications. U.S. Pat. No. 5,697,175, to Schwartz, discloses a low power illuminated sign that is particularly adapted for use with common EXIT signs over doorways. The back of each sign comprises a reflector with a series of cavities with curved surfaces. Each cavity corresponds to a letter and background area in the sign. LEDs are mounted in the center of the cavities to illuminate the letters or background area. The LEDs are provided on a separate perpendicular circuit board or on a central projection formed in the bottom of the cavities, with light from the LEDS directed outward. The letters and background area of the sign are illuminated by light reflecting forward from the curved surfaces of the cavities, so that the only visible light is from the illumination of the cavities.

U.S. Pat. No. 6,042,248, to Hannah et al., discloses an LED assembly for channel letter illuminating signs having an enclosure/housing covered by a translucent lens. Each sign includes a plurality of track moldings at the base of its enclosure, with the moldings running along the longitudinal axis of the sections of the channel letter. Linear arrays of LEDs are mounted on printed circuit boards (PCBs) that are then mounted in the track moldings. Each track molding can hold two PCBs in parallel with each of the PCBs arranged on a longitudinal edge, with the LEDs directed outward.

LED based channel letter lighting is also available from LumiLEDs, Inc., under part numbers HLCR-KR-R0100 and HLCR-KR99-R0200, which comprises LEDs that are each mounted by insulation displacement connectors (IDC) on two inch centers. The chain of LED modules is then mounted into a bendable clip or rail, each of which are then mounted inside a channel letter to hold the LEDs in place. Power is provided by a combination of an AC/DC mother power supply and a DC/DC daughter power supply. A sensing LED is also included as a temperature and current sensor.

SUMMARY OF THE INVENTION

The present invention provides apparatus and methods that allow power supplies to automatically provide the appropriate voltage to drive constant current devices.

One embodiment of a system for powering a constant current device is comprised of a constant current device that operates at a constant current in response to constant current voltage. A power supply is included that generates a power supply voltage coupled to the constant current device. A feedback circuit is included from the constant current device to the power supply causing the power supply voltage to equal the constant current voltage.

One embodiment of a lighting system according to the present invention comprises a lighting module having a constant current device that provides a constant current in response to constant current voltage. A power supply is included that generates a power supply voltage coupled to the lighting module. A feedback circuit is included from the lighting module to the power supply causing the power supply voltage to be sufficient to provide a constant current voltage at the LED module.

One embodiment of a power supply feedback circuit according to the present invention comprises a means for sensing current and a control circuit for sampling the sensed current. The control circuit generates power supply control signals to cause a power supply to increase its output voltage when the sensed current is increasing between samplings and to hold its output voltage when the current is not increasing between samplings.

One embodiment of a method according to the present invention for generating a constant current voltage to drive a constant current device, comprises providing a drive voltage to a constant current device. The current at the constant current device is sensed a first time, and the drive voltage is increased. The current to the constant current device is sensed a second time. The drive current is held at its increased level if the current did not increase from the first to the second sensing. The increasing of the drive voltage and sensing of the current is repeated if the current did increase between the first and second sensing.

These and other further features and advantages of the invention will be apparent to those skilled in the art from the following detailed description, taken together with the accompanying drawings, in which:

BRIEF DESCRIPTION OF THE DRAWINGS

FIG. 4 is a graph showing the voltage and current characteristics for one embodiment of an adjusting circuit according to the present invention;

FIG. 5 is a schematic of one embodiment of an adjusting circuit according to the present invention;

DESCRIPTION OF THE INVENTION

The present invention is described herein with reference to certain embodiments, but it is understood that the invention can be embodied in many different forms and should not be construed as limited to the embodiments set forth herein. In particular, the present invention is described below in regards to certain schematics or circuits, but it is understood that the present invention can be embodied in many other circuits arranged in different ways. The invention is also described in regards to lighting systems such as channel letters utilizing LED modules but the present invention can be utilized with many other systems.

It is understood that when an element is referred to as being "adjacent", "connected to" or "coupled to" another element, it can be directly adjacent, connected to or coupled to the other element or intervening elements may also be present. Furthermore, relative terms such as "inner", "outer", "upper", "above", "lower", "beneath", and "below", and similar terms, may be used herein to describe a relationship of one element to another. It is understood that these terms are intended to encompass different orientations of the device in addition to the orientation depicted in the figures.

Although the terms first, second, etc. may be used herein to describe various elements, components, and/or sections, these elements, components, and/or sections should not be limited by these terms. These terms are only used to distinguish one element, component, or section from another region, layer or section. Thus, a first element, component, or section discussed below could be termed a second element, component, or section without departing from the teachings of the present invention.

Constant current devices can be used with many different systems and in many different ways, with many of these systems driven by a power supply. LED based systems and circuits can utilize constant current devices to keep the current through the LEDs relatively constant during operation. This protects the LEDs from being overdriven by excessive current that can lead to premature failure. Different commercially available constant current devices can be used, with a suitable device being an LM317M 3-Terminal Adjustable Regulator provided by Texas Instruments, National Semiconductor, and Fairchild Semiconductor.

Figure 1:
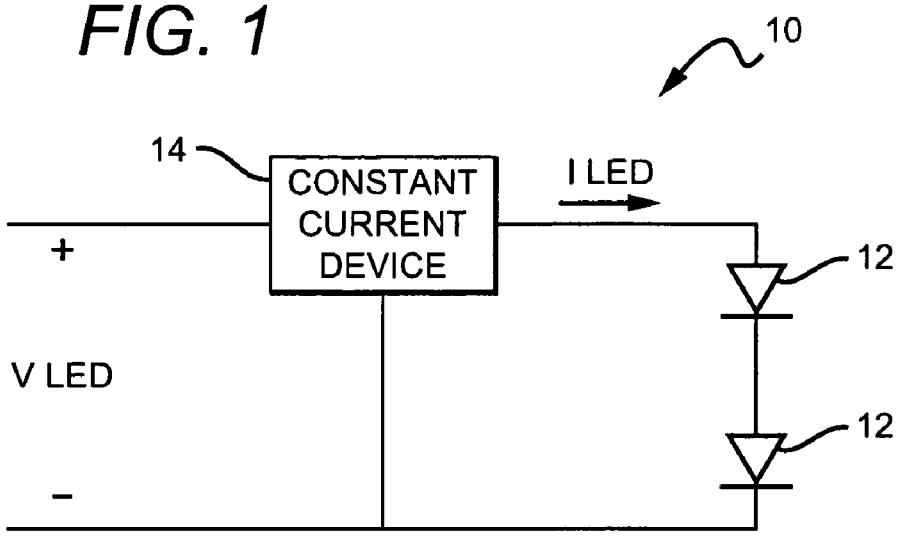
FIG. 1 is a schematic of an LED module utilizing a constant current device.

FIG. 1 shows one embodiment of an LED circuit/module 10 that can be used in different applications, but is particularly applicable to back lighting channel letters in a sign. The module 10 is shown as having two LEDs 12 connected in series driven by $V_{LED}$ input. A constant current device 14 is arranged between the $V_{LED}$ input and the LEDs 12 and produces a constant current to the LEDs 12 once a minimum voltage is reached at $V_{LED}$ input. As $V_{LED}$ input voltage increases the current from the constant current device increases in a linear fashion until a certain minimum voltage is reached. After that, if the voltage is increased the current provided from the constant current device that is fed through the LEDs remains constant.

Figure 2:
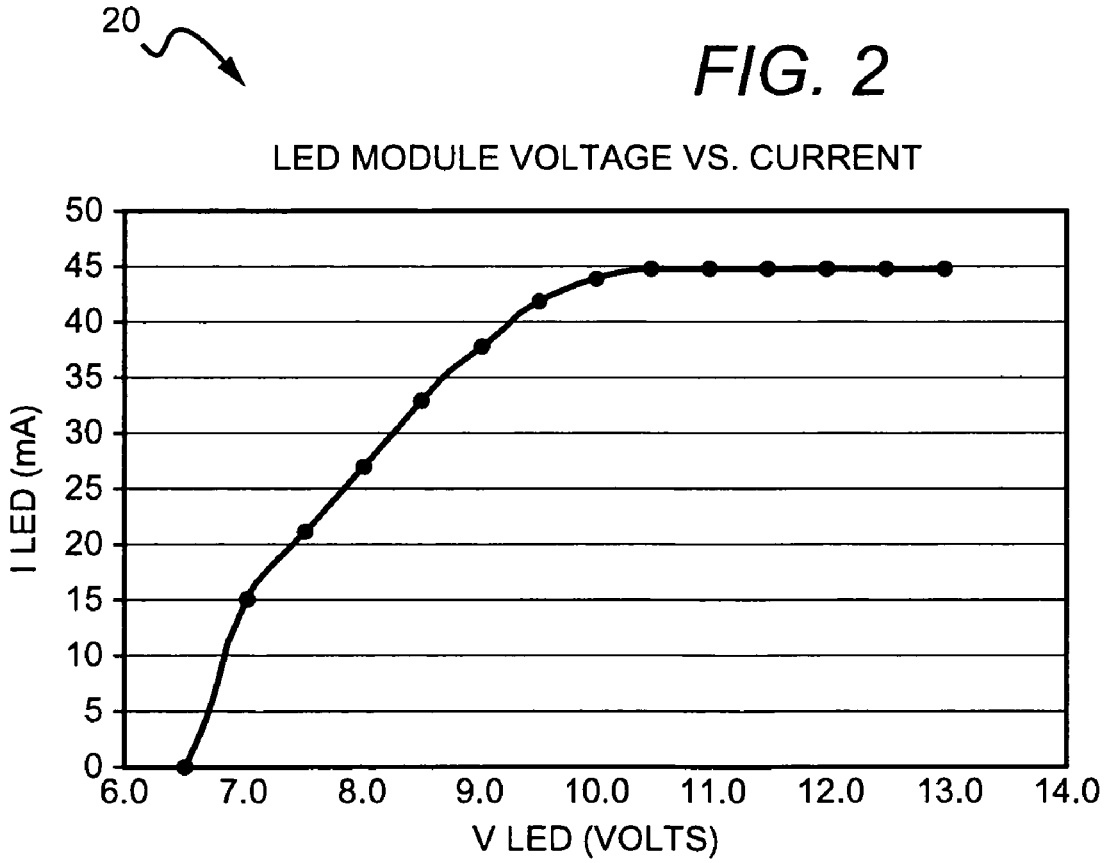
FIG. 2 is a graph showing the voltage verses current characteristics for an LED module utilizing a constant current device.

FIG. 2 shows a graph 20 of the relationship of current provided by the constant current device ($I_{LED}$) as a function of input voltage $V_{LED}$. In the embodiment shown, $I_{LED}$ increases approximately linearly as the voltage increases from approximately 6.5 volts to 10 volts, at which point $I_{LED}$ provides a constant current as the voltage increases.

In applications such as where LED modules are used to back light a channel letter sign, the number of LED modules can vary depending on the size of the letter and the number of letters in the sign. Each LED module can have a constant current device and can have the electrical characteristics shown in FIG. 2. In one conventional embodiment the maximum current that a module draws is 45 milliamps. A channel letter sign can have as little as a few modules or as many as 100 modules or more, all of which are powered by a single power supply. Accordingly, the channel letter's power supply can produce as little as a couple hundred milliamps to as high as 5 amps depending on how many modules are used. There can also be voltage drop in the wiring between the sign and the LEDs due to resistance in the wire. This voltage drop can vary depending on the current through the circuit, the gauge of the wire and length of the wire. These variables are not easily controlled by the sign manufacturers and can have an adverse effect on the voltage the LED modules see in the sign.

The present invention provides a self adjusting power supply that is particularly applicable to powering an electrical circuit having constant current devices, or other similar devices having the voltage/current characteristics shown in FIG. 2. The power supply is coupled to the desired constant current device circuit and the current supplied to the circuit is monitored and sampled periodically by a feedback circuit. In operation, the power supply provides an initial, relatively low, operating voltage. The feedback circuit initially signals to the power supply to increase its voltage and the current is sampled. If the current continues to increase as the voltage increases, the power supply continues to increase its voltage output. As the voltage initially increases the current through the constant current device increases in a generally linear fashion until sufficient voltage is supplied to allow operation in a constant current mode. When the current no longer increase as the voltage increases, the constant current circuits are functioning properly in the constant current mode. This transition point is the proper operating voltage for the constant current device circuit and the power supply is signaled to discontinue increasing and to operate at this desired voltage.

This ramp-up in current is utilized by the present invention to set the appropriate voltage level to the particular system it is driving. The power supply output voltage is set at the voltage necessary for the constant current devices to operate in the constant current. This level can be different for different circuits and systems based on the type and number of devices being driven as well as the transmission loss due to wire length and gauge. The voltage output can also vary over time or in different environmental conditions. The present invention allows the power supply to compensate for these different conditions and to self adjust to meet these different applications.

The present invention utilizes a feedback circuit/network that determines where the power supply is operating on the voltage current characteristics plot as shown in FIG. 2. If the power supply is operating in the linearly increasing portion, the feedback network signals the power supply to continue increasing its voltage. When the power supply begins operating in the constant current portion (i.e. there is no current change with an increase in voltage) the feedback network signals the power supply to discontinue increasing its voltage.

Figure 3:
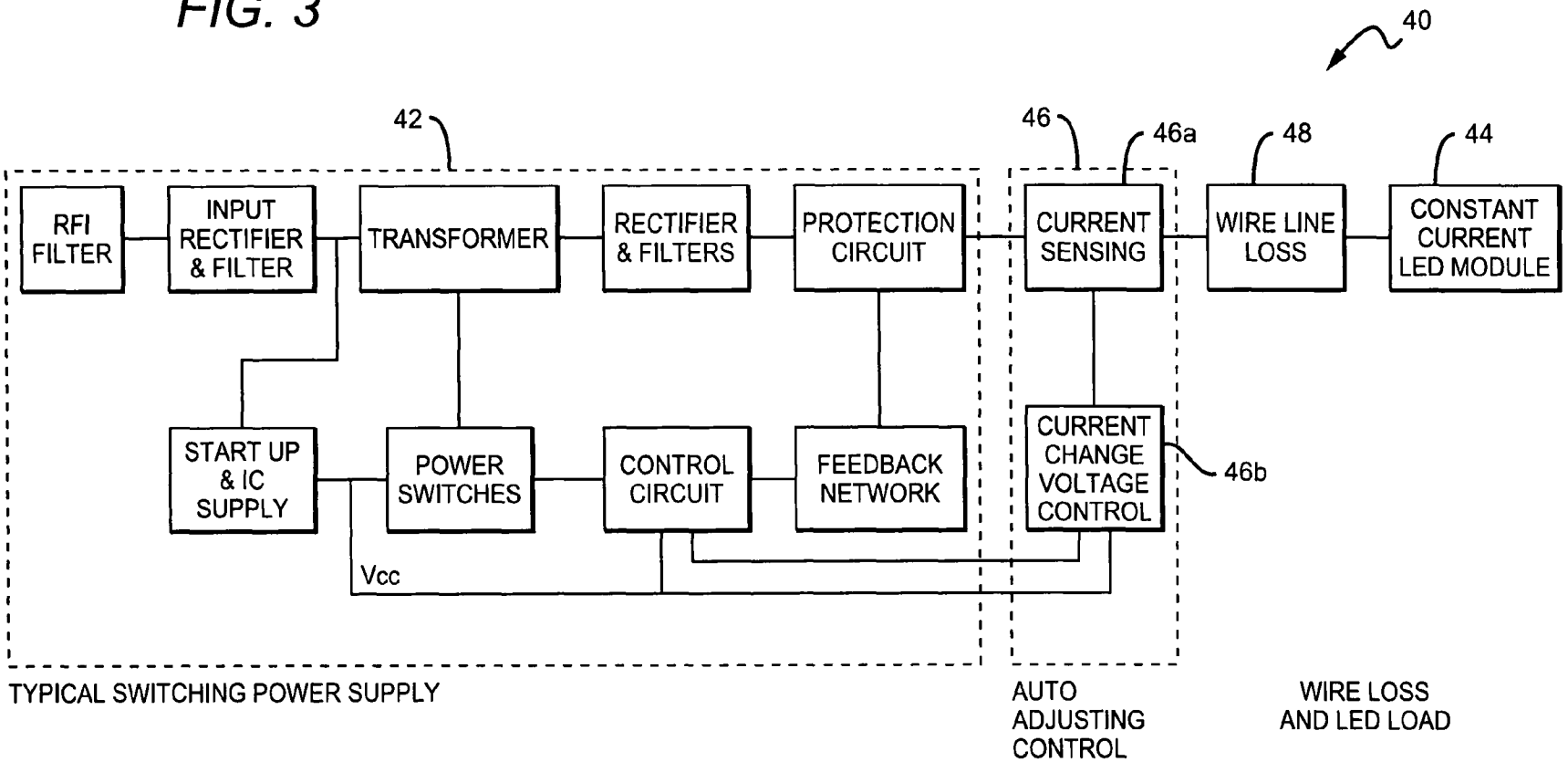
FIG. 3 is a schematic of one embodiment of a lighting system according to the present invention.

FIG. 3 shows a block diagram of one embodiment lighting system 40 according to the present invention comprising a power supply 42 coupled to a constant current LED module 44 through an auto/self adjusting feedback circuit 46. Although the power supply 42 is shown driving a single LED module 44 it is understood that it can drive a plurality of LED modules 44. In some embodiments it can drive up to 100 or more LED modules 44. The block diagram also shows wire line loss 48 between the adjusting circuit 46 and the LED module 44, which can vary as mentioned above depending on the gauge and length of wire between the power supply 42 and auto adjusting circuit 46, and the LED module 44. Wire line loss 48 can also vary depending on the length of wire between the LED modules in a multiple LED module embodiment, such as channel letter applications.

The power supply 42 can be many different power supply types, and the embodiment shown comprises a conventional switched-mode power supply. Its functional blocks and operation are generally known in the art and are briefly discussed herein. A switched-mode power supply or switching-mode power supply (SMPS) is an electronic power supply unit (PSU) that incorporates a switching regulator. While a linear regulator maintains the desired output voltage by dissipating excess power in a "pass" power transistor, the SMPS rapidly switches a power transistor between saturation and cutoff with a variable duty cycle whose average is the desired output voltage. The resulting rectangular waveform is low-pass filtered with an inductor and capacitor. The main advantage of this power supply method has greater efficiency because the switching transistor dissipates little power in the saturated state and the off state compared to the semiconducting state. Other advantages include smaller size and lighter weight from the elimination of low frequency transformers which have a high weight, and lower heat generation from the higher efficiency. Disadvantages include greater complexity, the generation of high amplitude, high frequency energy that the low-pass filter must block to avoid EMI, and a ripple voltage at the switching frequency and the harmonic frequencies thereof.

According to the present invention power supply 42 has an internal feedback network and can also accept external signals, both of which can be used to control the output voltage provided by the power supply. In the embodiment shown the external control signals are provided by the adjusting feedback circuit 46, which in the embodiment shown can provide a signal to the control circuit that can then pulse the power switches to the transformer.

The feedback circuit 46 provides the control necessary to allow the system 40 to utilize the unique voltage/current characteristics of constant current devices as shown in FIG. 2. This circuit 46 senses the current provided by the power supply 42 at the circuit sensing 46*a*, which is then provided to the circuit change voltage control 46*b*. This combination determines whether the power supply 42 is operating in a linearly increasing mode or is in the constant current portion. The circuit 46 provides a signal to the power supply 42 to increase the voltage and then senses the current after each increase. If current increases as the voltage increases, then the power supply is operating in the linearly increasing portion. If the current does not increase as the voltage increases the power supply is operating in the proper constant current portion of the curve.

FIG. 4 is a graph 60 showing the power supply voltage output 62 and the current output 64 for one embodiment of a power supply powering constant current devices. The constant current devices typically will not start conducting current until the voltage output reaches a threshold, which in this embodiment is approximately 6.5 volts. Thus the constant current devices do not start conducting until approximately t=3. After that point, if the current increases as the voltage increases, the constant current devices of the LED modules are not operating in the constant current mode. At approximately t=8, the voltage from the power supply is 12V and current output from the power supply begins to flatten out. At t=9 the adjusting circuit determines that it has reached the proper operating voltage because the output current has not increased with an increase in voltage. The adjusting circuit can then set the operating voltage to be slightly above what is needed to operate in the constant current mode. In this embodiment, the voltage is set slightly above the 12V necessary for constant current operation.

In some embodiments the adjusting circuit may "overshoot" the desired operating voltage before the adjusting circuit determines it is operating in the constant current portion. As shown in graph 60, at t=9 the voltage increases to approximately 13V before it determines its constant current operation. The adjusting circuit can then reduce its output voltage slightly as shown to compensate for this overshoot.

In the embodiment, the power supply produces 12V before the LED modules operate in the desired constant current mode. In the embodiment shown, the constant current devices operate at constant current in the range of 9-10v. This voltage provided by the power supply is approximately 2V higher than the 9-10V required. This additional 2V can represent loss due to wire resistance because of gauge or length. The power supply and adjusting circuit are designed to work together to reach the proper operating voltage independent of the particular application and what the actual current is. The adjusting circuit only looks for change in current as the voltage changes. The absolute value of the current need not be known and can vary depending on the modules in the sign and the voltage loss, such as through the wiring. It is the constant current that is the important factor and the present invention insures constant current regardless of the number of LED modules or wire line loss.

FIG. 5 shows one embodiment of an adjusting feedback circuit 70 according to the present invention. The power supply generates a power supply output voltage 72 that is passed through adjusting circuit 70 to constant current LED module 74. As with the embodiments described above, a plurality of LED modules can be driven by the power supply and line loss can be experienced by the gauge and length of wire in the system. The circuit 70 comprises a current sense device 75 that senses the current on the power supply output voltage. The sense device can comprise many different known components such as a shunt resister. The current level is sensed and coupled to A/D input of a micro controller 76 through amplifier 78. The microcontroller 76 comprises a software algorithm that senses the current input from the amplifier 78 and determines whether the current is increasing from the last sample. If it is increasing, a voltage control signal is generated at a D/A output of the microcontroller that is coupled to the power supply control circuit 80 causing the power supply to increase its output voltage. If the current is not increasing, a signal is generated causing the power supply to set its operating voltage or to adjust for voltage overshoot as described above.

At is understood that although the feedback circuits are shown using a microprocessor, the circuits can instead comprise different analog and digital elements coupled together in different ways. These elements can perform essentially the same function as the microprocessor.

Figure 6:
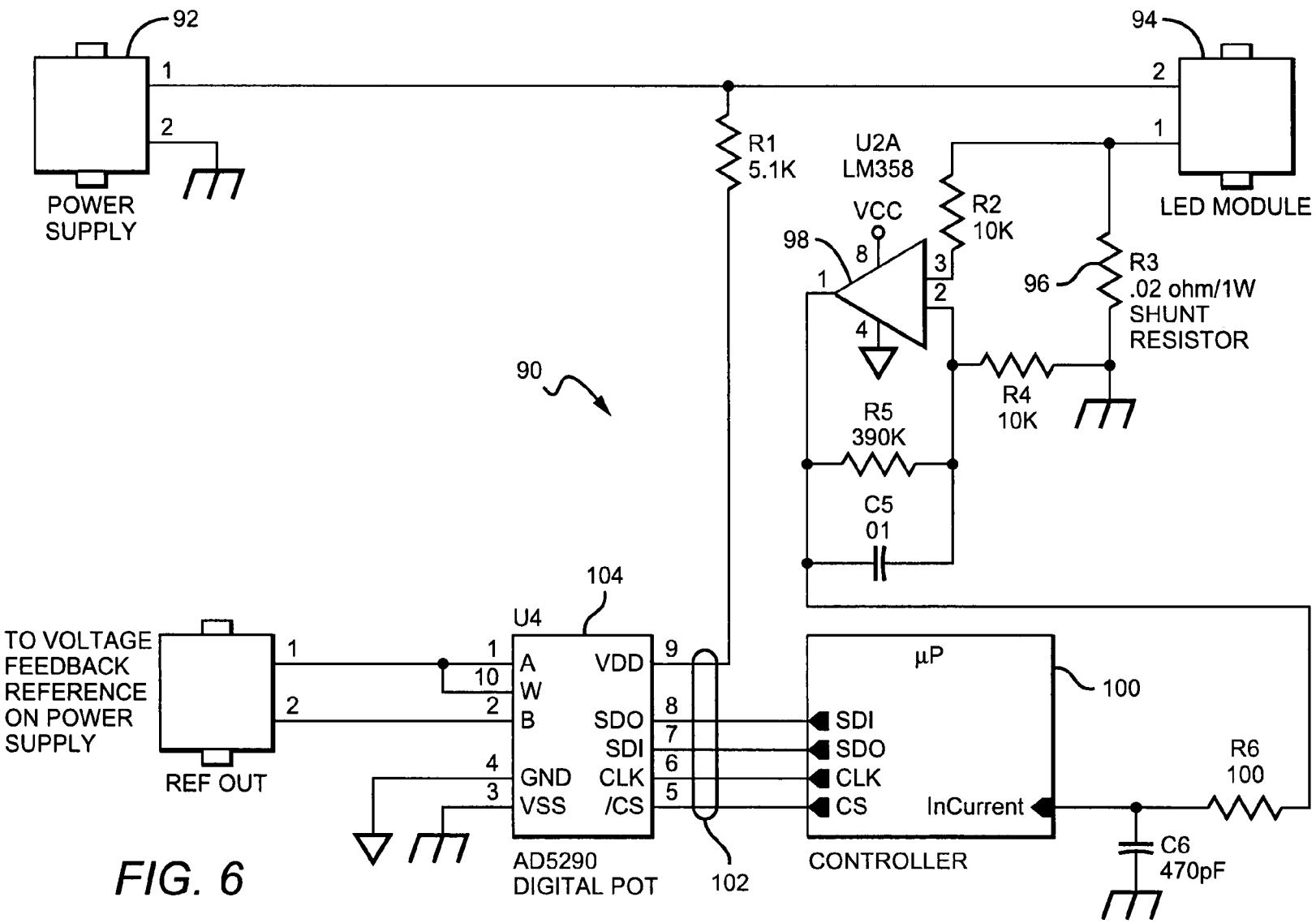
FIG. 6 is a component schematic of another embodiment of an adjusting circuit according to the present invention.

FIG. 6 shows a more detailed schematic of one embodiment of a self adjusting circuit 90 according to the present invention, and although the circuit 90 is shown and described with reference to certain devices/components coupled together in certain ways, it is understood that other embodiments of adjusting circuits can be comprise other devices/components coupled together in different ways. Like the embodiments described above, a power supply 92 is coupled to a constant current LED module 94, and although the power supply 92 is shown driving a single LED module 94, it can drive a plurality if interconnected LED modules as described above. The LED module or interconnected LED modules will also have some associated line loss as described above.

The self adjusting feedback circuit 90 is coupled between the power supply 92 and LED module 94 forming a microprocessor based feedback path between the two. The feedback circuit 90 begins with a shunt resister 96 that is coupled between the LED module 94 and ground. The current being supplied to the LED module passes through the shunt resister 96 to ground. Many different devices can be used for resister 96, but its value should be relatively small so that it draws a minimal amount of power. In the embodiment shown the resister has a value of 0.02 ohm/1 W.

An amplifier 98 is coupled across the resister 96 to measure the voltage across the resister. The amplifier 98 comprises resisters and a capacitor coupled to the amplifier 98, to operate as desired. Many different amplifier can be used, such as the commercially available LM358 Low Power Dual Operation Amplifier provided by National Semiconductor.

The amplifier 98 measures the voltage across the shunt resister 96 and generates a voltage corresponding thereto. The voltage across the shunt resister 96 is relatively low, so to provide a usable voltage from the amplifier 98, the amplifier 98 can also scale up the voltage it provides. For example, if the voltage across the shunt resister is 10 mV the current provided by the amplifier can be scaled-up to 1V.

The voltage from the amplifier 98 is coupled to a microprocessor that is programmed to sample the voltage provided and generate control signals to the power supply 92 in response to the level of the current provided by the amplifier 98. Many different commercially available microprocessors can be used, such as the commercially available PIC16C56 from Microchip Technology, Inc. The microprocessor can be programmed using known programming techniques.

In the embodiment shown, the microprocessor 100 generates control lines 102 that are coupled to a digital potentiometer 104. Digital potentiometers are digitally-controlled components that mimic the analog functions of a potentiometer. Using the control signals provided by the microprocessor 100 the digital potentiometer 104 provides and an adjustable output voltage that is coupled to the power supply 92, completing the feedback circuit of the adjusting circuit. Many different digital potentiometers can be used, such as the AD5290 Compact Position Digital Potentiometer provided by Analog Devices.

In operation, the voltage across the shunt resister 96 increases as the current provided to the LED module 94 increases. This in turn results in an increase in the current provided by the amplifier 98. The microprocessor sample the current and as the current increases through the samples, the control signals provided by the microprocessor 100 cause the digital potentiometer to increase the voltage supplied to the power supply 92. This in turn causes the power supply 92 to increase the voltage it generates. When the LED module begins operating in constant current mode, the current to the LED module 94 stops increasing with a corresponding increase in voltage from the power supply 92. The voltage across the shunt resister 96 stops increasing, and the current generated by the amplifier 98 stops increasing. The sampling taken by the microcontroller detects that the current is not increasing and the control signals provided by the microprocessor 100 cause the digital potentiometer to hold the voltage it is generating. This causes the power supply to hold the voltage it is generating.

The microprocessor 100 can also be programmed to slightly reduce the power supply's output voltage when it senses that the current to the LED modules 94 is no longer increasing. This can adjust for any overshoot that may be experienced before the adjusting circuit determines that the LED modules 94 are operating in constant current mode.

Figure 7:
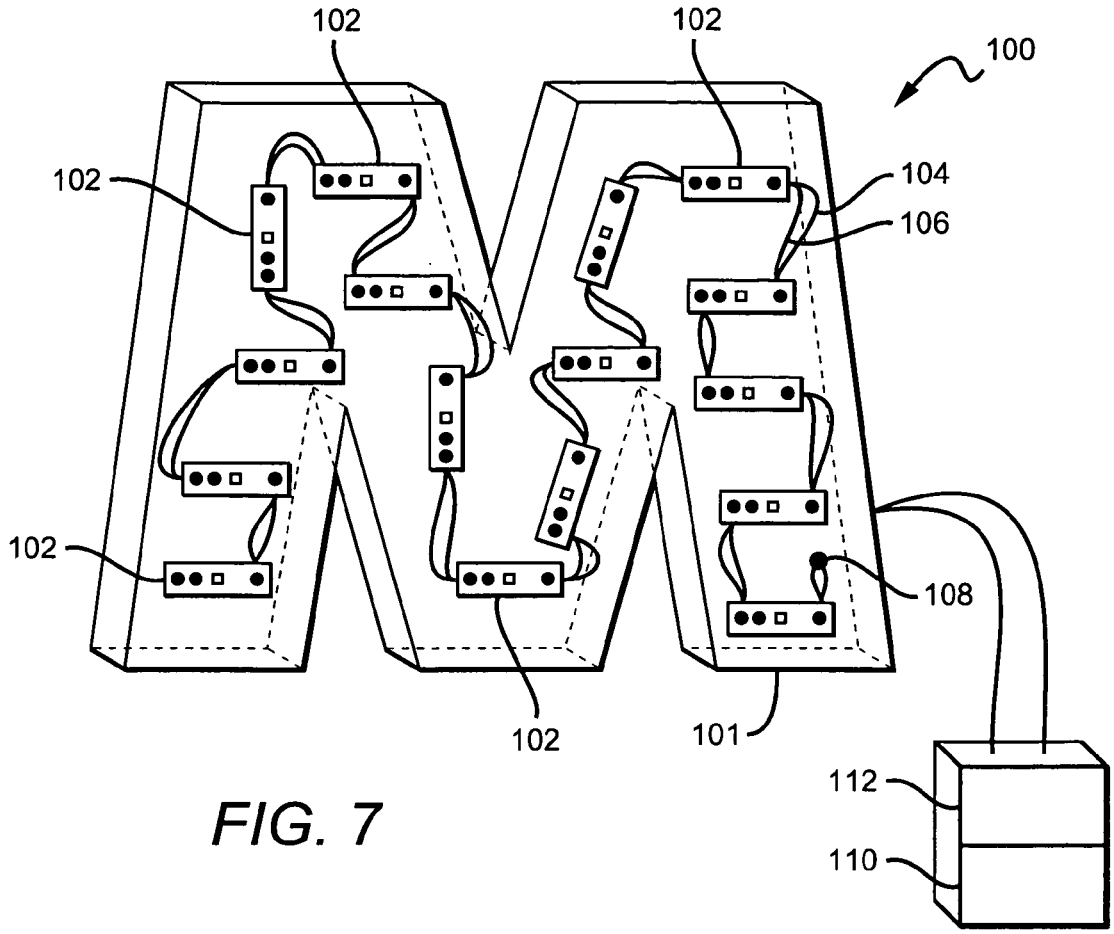
FIG. 7 is a perspective view of one embodiment of a channel letter according to the present invention.

As mentioned above, the present invention can be used in many applications having constant current devices. FIG. 7 shows one embodiment of a channel letter 100 according to the present invention having a lighting system constant current LED modules 102 mounted within it. In the embodiment shown, sixteen (16) units 102 are mounted to the bottom surface of the channel letter housing 101. First and second conductors 104, 106 enter the channel letter through a hole 108 in the base and the conductors pass to each of the modules 102. Electrical power can be applied to modules from a power supply 110 that also comprises an auto/self adjusting circuit 112 that senses the current applied to the modules 102 and controls the voltage supplied by the power supply 110 as described above. The conductors 104, 106 are preferably flexible, allowing the units 102 to be mounted at different angles and with different distances between adjacent units 102. This allows the units 102 to be optimally dispersed throughout the channel letter 100 so that when the transparent/translucent cover is mounted over the opening of the channel letter, the channel letter 100 appears as though it has a continuous light source.

Figure 8:
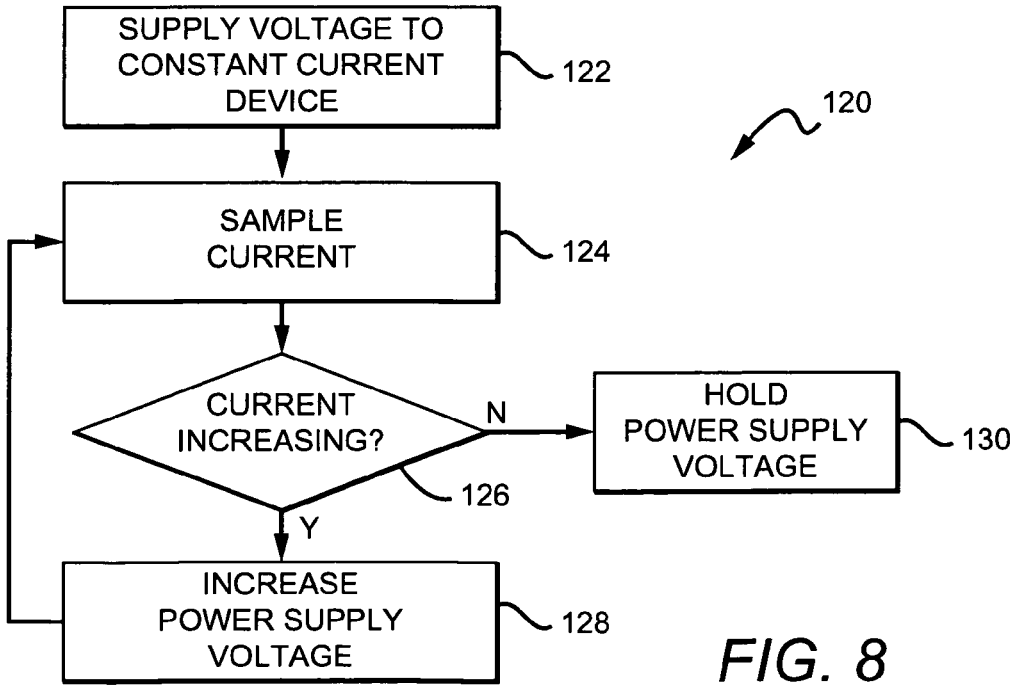
FIG. 8 is a flow diagram for one embodiment of a method according to the present invention.

The present invention further comprises methods for controlling the output of a power supply to properly drive constant current devices. Referring now to FIG. 8, one such method 120 according to the present invention is shown, but it is understood that other embodiments according to the present invention can have different steps occurring in different order. In 122, a voltage from a power supply is applied to a constant current device, and in one embodiment a switching mode power supply described above can be used. In one embodiment the constant current device can be an LED module having a constant current devices arranged to that a constant current is applied to the LED when a certain voltage is reached. As above, one or a plurality of LED modules can be used. The power supply voltage is increased and in 124, the operating current of the constant current device is sampled as the voltage increases. In one embodiment the sampling step can be accomplished using the shunt resister, amplifier and microprocessor combination described above.

In 126 a determination is made as to whether the operating current of the constant current device is increasing. This determination can be made by the microprocessor described above. If the current is increasing, in 128 the power supply is signaled to increase the voltage it is providing to the constant current device. The current is then again sampled in 126, and if it is increasing, in 128 the power supply is again signaled to increase the voltage it is providing. This repeats until a determination is made in 126 that the current is not increasing. If it is not, in 130 the power supply is signaled to hold the voltage it is providing.

Different methods according to the present invention can have additional or fewer steps. For example, in one embodiment the method can include the step of compensating for any voltage overshoot as described above.

Although the present invention has been described in considerable detail with reference to certain preferred configurations thereof, other versions are possible. Therefore, the spirit and scope of the invention should not be limited to their preferred versions described above.

We claim:

1. A lighting system, comprising:

a lighting module having a constant current device that provides a fixed constant current in response to an input voltage when said input voltage equals or exceeds a minimum voltage;

a power supply generating a power supply voltage coupled to said lighting module; and a feedback circuit from said lighting module to said power supply causing said power supply voltage to be sufficient to provide said input voltage to said lighting module such that said input voltage equals or exceeds said minimum voltage, wherein said feedback circuit comprises a microprocessor that generates control signals to said power supply capable of causing said power supply to change said power supply voltage until said input voltage equals or exceeds said minimum voltage, wherein said power supply voltage is decreased to compensate for voltage overshoot.

2. A lighting system, comprising:

a lighting module having a constant current device that provides a fixed constant current in response to an input voltage when said input voltage equals or exceeds a minimum voltage;

a power supply generating a power supply voltage coupled to said lighting module; and a feedback circuit from said lighting module to said power supply causing said power supply voltage to be sufficient to provide said input voltage to said lighting module such that said input voltage equals or exceeds said minimum voltage, wherein said feedback circuit comprises a microprocessor that generates control signals to said power supply capable of causing said power supply to change said power supply voltage until said input voltage equals or exceeds said minimum voltage, further comprising a potentiometer that accepts control signals from said microprocessor and generates a control voltage to said power supply.

3. A system for powering a constant current device, comprising:

a constant current device that operates at a fixed constant current in response to an input voltage when said input voltage equals or exceeds a minimum voltage;

a power supply generating a power supply voltage coupled to said constant current device; and a feedback circuit from said constant current device to said power supply causing said power supply voltage to equal said input voltage, wherein said feedback circuit comprises a microprocessor that generates control signals to said power supply capable of causing said power supply to change said power supply voltage until said input voltage equals or exceeds said minimum voltage, wherein said microprocessor compensates for voltage overshoot.

* * * * *